US006244921B1

(12) United States Patent
Pope

(10) Patent No.: US 6,244,921 B1
(45) Date of Patent: Jun. 12, 2001

(54) FIN ATTACHMENT SYSTEM ALLOWING ROLL ANGLE ALIGNMENT

(76) Inventor: Karl D. Pope, 605 Pope La., Ojai, CA (US) 93023

( * ) Notice: Subject to any disclaimer, the term of this patent is extended or adjusted under 35 U.S.C. 154(b) by 0 days.

(21) Appl. No.: 09/490,864

(22) Filed: Jan. 24, 2000

(51) Int. Cl.[7] ..... B63B 1/00
(52) U.S. Cl. ..... 441/79; 114/130
(58) Field of Search ..... 114/130, 132, 114/135–137, 140, 143; 441/79

(56) References Cited

U.S. PATENT DOCUMENTS 1,703,868 * 3/1929 Chisholm, Jr. ..... 441/79
4,811,674 * 3/1989 Stewart ..... 441/79

* cited by examiner

*Primary Examiner*—Jesus D. Sotelo
(74) *Attorney, Agent, or Firm*—Lyon, Harr & DeFrank, LLP; Richard T. Lyon; Katrina A. Lyon

(57) ABSTRACT

A fin assembly for securing a fin to a water craft in a desired angular position relative to a longitudinally oriented axis of the water craft, i.e. the roll angle, is provided in the form of a fin mounting mechanism incorporated in the bottom surface of the water craft and a detachable fin. The attachment mechanism includes a fin mounting box with an elongated channel defined in part by a pair of spaced longitudinal extending side walls. A rotating bar is inserted within the elongated channel of the mounting box and two end caps are affixed to the fin mounting box to hold the rotating bar into the fin mounting box. The end caps when loosened allow the rotating bar to rotate freely and when tightened hold the rotating bar fixedly in place. In this way the detachable fin's roll angle can be easily and accurately selected, fixed and adjusted.

14 Claims, 4 Drawing Sheets

FIN ATTACHMENT SYSTEM ALLOWING ROLL ANGLE ALIGNMENT

BACKGROUND OF THE INVENTION

1. Technical Field

This invention relates to a fin attachment structure for surfboards or other water craft such as sailboards and boats, and, more specifically, to an improved fin attachment structure that allows the roll angle alignment of the fin to be adjusted.

2. Background Art

Conventional surfboards and other water vehicles are often provided with fixed fins or skegs on their underside. These fins are subjected to great strains and stresses due to the nature of water sports and are often damaged. For example, in the case of a surfboard, the fin(s) are susceptible to being pushed into hard sand or rocks on the shore. Because the fins are fixed on conventional surfboards, it is often necessary to dispose of the surfboard once the fin or fins are damaged. Furthermore, the fixed fin configuration makes storage, handling and shipping of the surfboard very cumbersome. The fins are also often damaged in storage and shipping.

Another disadvantage of surfboards and other water craft employing rigidly fixed fins is that it is difficult to align the roll angle of the fin or fins, (i.e. the angular position of the fin relative to a longitudinal axis on the bottom surface) during the manufacturing process. Even if the roll angle is as desired when the fin is first mounted, this angle may shift as the manufacturing process progresses. Aligning the roll angles of the fins properly is particularly difficult when there is more than one fin. For example, the roll angle of multiple fins (such as in a side-by-side configuration) typically must be aligned with respect to each other to give the surfboard the desired surfing characteristics. Since the fins are fixed, any misalignment in roll angle cannot be corrected and the board may be ruined.

As mentioned above, it is believed that the fin roll angle can be important in determining certain surfing characteristics of the board. Being able to adjust a fin's roll angle could allow a surfer to customize the performance of the board. However, the fixed configuration of conventional fins prevents the surfer from adjusting the fins to a desired angular position to correct or vary the surfboard's characteristics.

Another disadvantage of a surfboard fin that is not removable or adjustable is that other geometrically shaped fins cannot be substituted for the normal fin to provide the board with different characteristics. Restriction to a single fin limits the performance characteristics of the board. Likewise restriction to a particular fin roll angle also limits the performance.

It is noted that similar problems also affect other water craft, such as sail boards, small boats and the like.

To prevent the common problems and disadvantages of the current fin attachment systems, an improved fin attachment system is required. This improved fin attachment system should allow the fin to be removed and reattached and allow the roll angle of the fin relative to the surfboard to be adjusted. Such an improved system would provide major advancements in functionality and practicality over the present technology. It would allow various fin shapes to be used and would allow the fin roll angle to be adjusted. It would also allow broken fins to be easily replaced, and finally, various water craft would be more easily manufactured, stored and shipped.

SUMMARY

The present invention overcomes the common problems and disadvantages of prior fin attachment assemblies with a fin attachment structure wherein the roll angle of the fin can be readily adjusted. Further, the fin attachment arrangement embodying the present invention provides a structure wherein a fin may be easily inserted or removed in a minimum amount of time.

The fin assembly has a fin mounting base installed within the underside of a water craft. The mounting base has an elongated channel defined by a pair of longitudinally extending side walls which terminate in a pivot block at each end of the channel. Each of the pivot blocks has a semi-circular shaped groove for receiving a cylindrical rotating bar, and threaded hole for receiving a threaded screw. The rotating bar has reduced diameter ends which fit into the semi-circular shaped grooves in the two pivot blocks. The radius of each groove is approximately the same as the radius of the reduced diameter ends of the bar. The rotating bar also has an elongated slot and a pin which perpendicularly traverses the slot. The rotating bar fits inside the elongated channel in the mounting base and is held in place by two cap pieces which are screwed onto each end of base such that they overlap the reduced diameter ends of the rotating bar. Each cap piece has a semi-circular shaped groove similar in size to the groove associated with the aforementioned pivot blocks, although it is not quite as deep. The upper portion of the reduced ends of the rotating bar are disposed within the grooves of the end pieces. Each of the end pieces has a through hole that overlies the threaded hole of the adjacent pivot block in the mounting base. In addition, there is a countersink depression in the top surface of each end piece at the top of the through hole. This depression accommodates the head of a retaining screw which extends through the through-hole and is threaded into the threaded hole of the pivot block. When fully tightened down, the retaining screws and end pieces trap and hold the reduced ends of the rotating bar so as to prevent the bar from rotating in relation to the mounting base. However, when the retaining screws are loosened slightly (although not removed so as to retain the cap pieces on the mounting base) the rotating bar is freed and can rotate in relation to the base within the pivot blocks.

The rotating bar is inserted such that its elongated slot faces upward. The fin has an extension protruding from its bottom that has a cross-sectional shape which matches the shape of the slot in the rotating bar. There is also a rotated L-shaped cut out in the fin extension having the shape of a clockwise rotated "L". The short leg of the cutout opens at the bottom surface of the fin and the long leg is directed towards the front of the fin. The cut-out forms a cantilevered finger that is hooked under the pin in the rotating bar. In order to seat the fin and thereby fix its longitudinal position, the fin is pulled backwards such that the pin of the rotating bar rides over the upper surface of the finger deflecting it downward slightly until the pin seats into a concave section at the proximal end of the finger. The finger then springs back into its original position, thereby trapping the pin and holding the fin in place. The fin (or what is left of it if broken) can be removed and replaced, by simply forcing the fin forward such that the cantilevered finger disengages from the pin in the rotating bar.

In operation, the fin's roll angle can be adjusted by loosening the rotating screws and freeing the rotating bar so that it can be rotated. After the fin is rotated to its desired roll angle the screws can be tightened and the fin will be held in this new roll angle. Note that it is not necessary when removing and replacing the fin to loosen the end cap screws, and so the roll angle will not be changed once the new fin is installed.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention. For example, while the following description is directed toward a surfboard, the structures and process to be described are equally applicable to other water craft.

Figure 1:
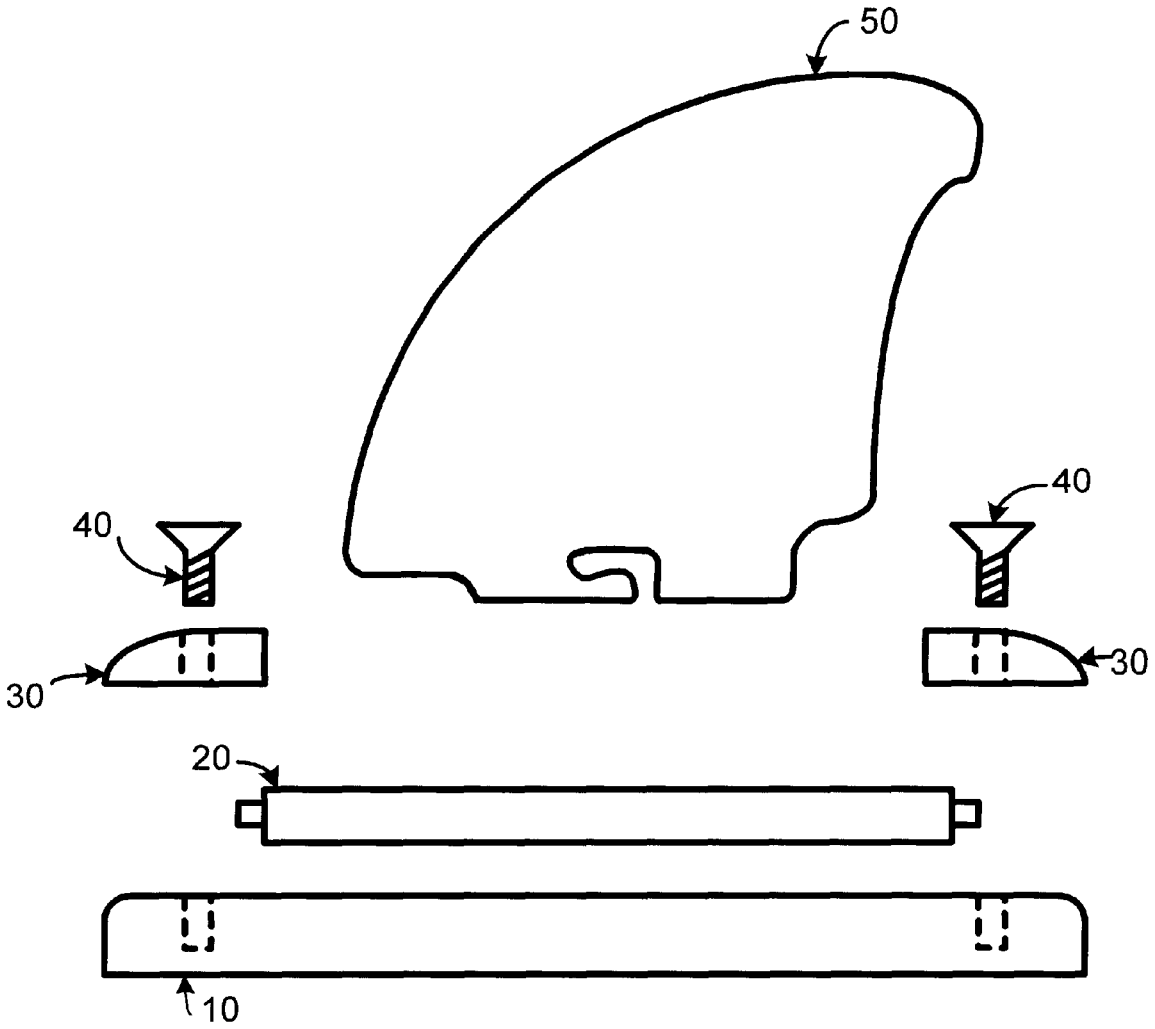
FIG. 1 is an exploded view of the fin attachment mechanism of the present invention.
Figure 2:
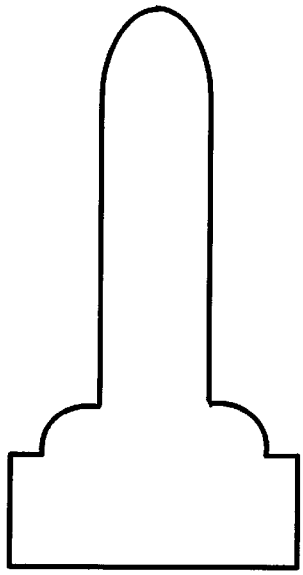
FIG. 2 is an assembled end view of the fin attachment mechanism of the present invention.
Figure 3A:
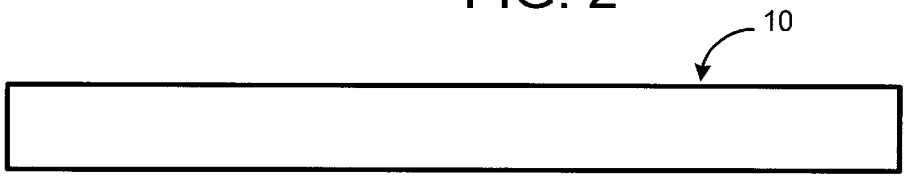
FIGS. 3A–3E provide views of the fin attachment mechanism base from various views.
Figure 3B:
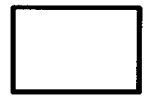
Figure 3C:
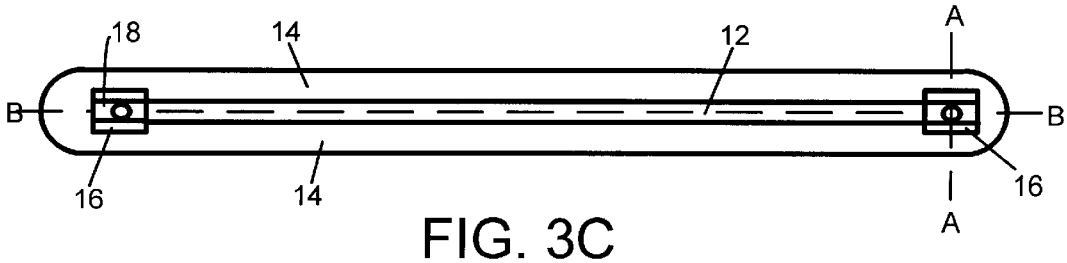
Figure 3D:
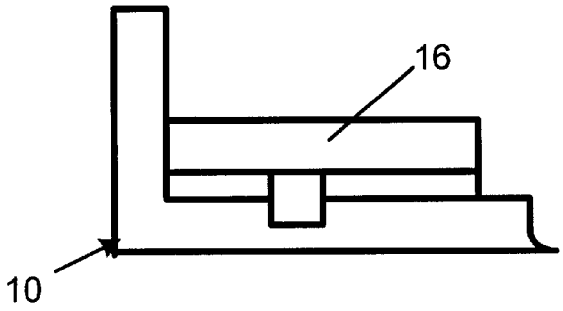
Figure 3E:
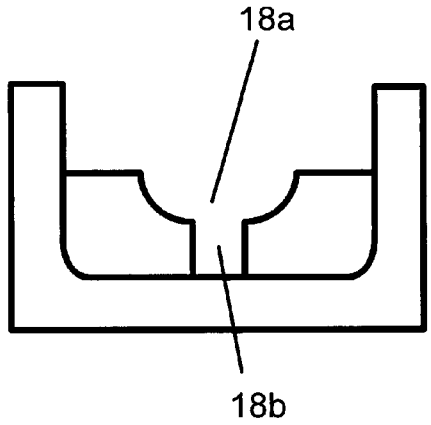
Figure 4A:
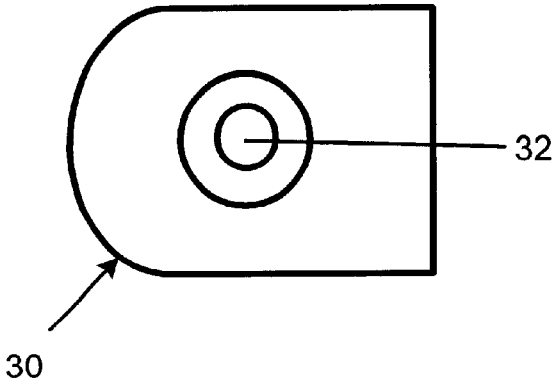
FIGS. 4A–4C provide top, side and cross-sectional end views of the cap piece of the present invention.
Figure 4C:
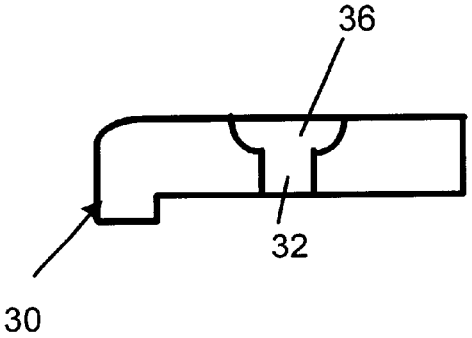
Figure 4B:
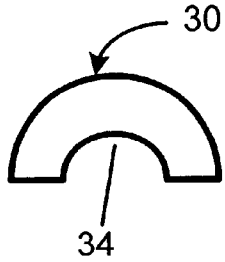
Figure 5A:
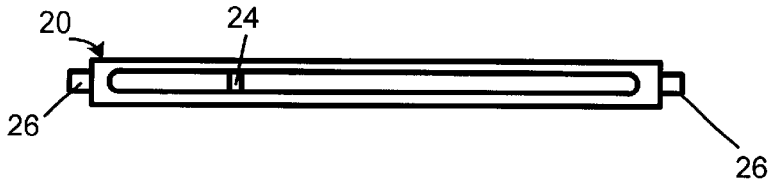
FIGS. 5A–5C provide top, side and cross-sectional end views of the rotating bar that fits into the fin base of the present invention.
Figure 5B:
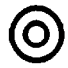
Figure 5C:
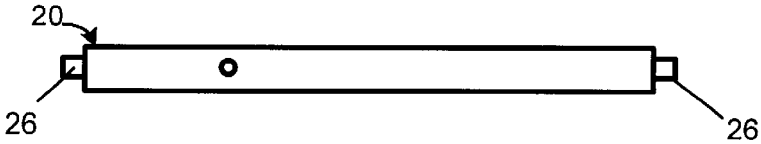
Figure 6A:
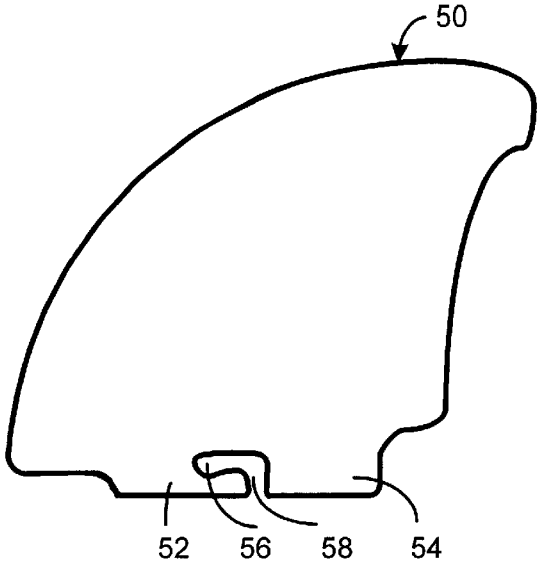
FIGS. 6A–6B provide a side and cross-sectional view of the fin of the present invention.
Figure 6B:
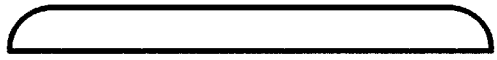

FIG. 1 shows the fin attachment assembly in an exploded view. The surfboard fin assembly has a fin mounting base 10 installed in the underside of a surfboard (not shown). FIG. 2 shows an end view of the fin attachment assembly in its assembled state. The mounting base 10, shown in FIG. 3, has elongated channel 12 defined by a pair of longitudinally extending side walls 14 which terminate in two pivot blocks 16 at each end of the channel 12. Each of the pivot blocks 16 has a semi-circular shaped groove 18*a* for receiving and cradling the reduced diameter ends of a cylindrical rotating bar 20. Each pivot block 16 also has a threaded hole 18*b* for receiving a threaded screw. As shown in FIGS. 4 and 5, the rotating bar 20 has an elongated slot and a pin 24 which perpendicularly traverses the slot 22. The rotating bar 20 fits within the elongated channel 12 in the mounting base 10 and is held in place by two cap pieces 30. As shown in FIG. 4, each of the end cap pieces 30 also has a through hole 32 that overlies the threaded hole 18*b* of the adjacent pivot block in the mounting base In addition, there is a countersink depression 36 in the top surface of each end piece 30 at the top of the through hole 32. This depression 36 accommodates the head of a retaining screw 40 which extends through the through hole 32 and is threaded into the threaded hole 18*b* of the pivot block 16. The two cap pieces 30 overlap the reduced diameter ends 26 of the rotating bar 20. Each cap piece 30 has a semi-circular shaped groove 34 similar in size to the groove associated with the aforementioned pivot blocks 16, although not quite as deep. The upper portion of the reduced diameter ends 26 of the rotating bar 20 are disposed within the grooves 34 of the cap pieces. When fully tightened down, the retaining screws 40 cause the end cap pieces 30 to trap and hold the reduced ends 26 of the rotating bar 20 so as to prevent the bar from rotating in relation to the mounting base 10. Specifically, the grooves 18*a* in the pivot blocks preferably have approximately the same radius as the reduced ends 26 of the rotating bar 20, thereby one half of the diameter of the reduced ends are cradled within the pivot blocks 16. Whereas the groove 34 in the cap piece 30 is not quite as deep, and so does not completely encompass the upper half of the reduced ends 26 of the rotating bar 20. This results is downward pressure being exerted on the reduced end 26 of the rotating bar 20 (versus the top surface of the pivot block 16) by the cap piece 30 when the retaining screws 40 are tightened down. In this way the rotating bar 20 is trapped between the blocks 16 and the cap pieces 30, and the rotating bar 20 is prevented from rotating. However, when the retaining screws 40 are loosened slightly (although not removed so as to retain the cap pieces 30 on the mounting base 10) the rotating bar 20 is freed and can rotate in relation to the base 10 within the pivot blocks 16.

The rotating bar 20 is inserted in the base 10 such that its elongated slot 22 faces upward. The fin 50 has an extension 54 protruding from its bottom that has a cross-sectional shape that matches the shape of the slot in the rotating bar. There is also a cutout 58 having a clockwise rotated "L" shape in the fin extension of the water craft. The short leg of the cutout opens at the bottom surface of the fin and the long leg is directed towards the front of the fin. The cutout 58 forms a cantilevered finger 52 that is hooked under the pin 26 in the rotating bar 20. In order to seat the fin 50, and thereby fix its longitudinal position, the fin 50 is pulled backwards such that the pin 24 of the rotating bar 20 rides over the upper surface of the finger 52 deflecting it downward slightly until the pin seats into a concave section 56 at the proximal end of the finger 52. The finger 52 then springs back into its original position, thereby trapping the pin 24 and holding the fin 50 in place. The fin 50 (or what is left of it if broken) can be removed and replaced, such as in the case that it becomes damaged, by simply grabbing it and forcing it forward such that the finger 52 disengages from the pin 24 in the rotating bar 20.

In operation, the fin's roll angle can be adjusted by loosening the retaining screws 40 and freeing the rotating bar 20 so that it can be rotated. After the fin 50 is rotated to its desired roll angle, the screws 40 can be tightened and the fin 50 will be held in this new roll angle. Note that it is not necessary when removing and replacing the fin 50 to loosen the screws 40 through the end caps 30. Thus, the roll angle will not be changed once a new fin is installed.

Since the fin's roll angle is easily adjustable it can be arranged to provide the optimum fin roll angle for each individual surfer. Furthermore, the ease of adjusting the roll angle of the fin makes it simpler to manufacture the board/fin combination, particularly in instances where two fins must be aligned with respect to each other.

The removability of the fin is advantageous in that it allows various fin shapes to be used to provide the board with different surfing characteristics. Additionally, if a fin should break, or be damaged, it can easily be repaired by the user. Storage and shipment of surfboards, with their fins temporarily removed or left for later assembly, is also more simple and provides a lesser likelihood that the fin would become damaged.

While the invention has been described in detail by specific reference to preferred embodiments thereof, it is understood that variations and modifications thereof may be made without departing from the true spirit and scope of the invention.

Wherefore, having thus described the present invention, what is claimed is:

1. A fin assembly comprising:

a fin mounting unit capable of being incorporated in the bottom surface of a water craft; and a fin attachable to the fin mounting unit; wherein the fin is rotatable in a first mode about a longitudinal axis of the fin mounting unit once attached thereto, so as to allow a selection of any desired roll angle of the fin in relation to the bottom surface of the water craft, and fixable in a second mode so as to prevent rotation about the longitudinal axis of the fin mounting unit, thereby fixing the roll angle of the fin.

2. The fin assembly of claim 1 wherein the fin mounting unit comprises:

a mounting box with an elongated channel defined in part by a pair of spaced longitudinal side walls; and a rotating bar insertable within the elongated channel of said mounting box and rotatable about a longitudinally oriented axis of said mounting box.

3. The fin assembly of claim 2 wherein the fin mounting unit further comprises :

two end caps respectively affixable to each end of the mounting box to hold the rotating bar therein, each end cap being configurable to, in said first mode, allow the rotating bar to rotate within the mounting box, and in said second mode, prevent the rotating bar from rotating within the mounting box.

4. The fin assembly of claim 3 wherein the roll angle of the fin relative to the longitudinal axis of the mounting box can be adjusted by configuring the end caps in said first mode and rotating the fin and rotating bar about the longitudinal axis of the fin mounting box until a desired roll angle is achieved, and then configuring the end caps in the second mode to fixedly hold the fin and rotating bar at the desired roll angle.

5. The fin assembly of claim 4 wherein said end caps are affixed to the mounting box with retaining screws, and wherein the end caps are configured in said first mode by loosening the retaining screws to rotate the fin and configured in said second mode by tightening said retaining screws to fixedly hold the fin.

6. The fin assembly of claim 3 wherein the fin mounting box further comprises a pair of mounting blocks disposed at each end of the elongated channel; and wherein, said rotating bar has reduced diameter ends; and each of the mounting blocks has a mounting block groove in a top surface thereof for receiving the reduced diameter ends of the rotating bar such that the rotating bar is supported within the elongated channel by the reduced diameter ends and mounting blocks and rotatable in relation to the fin mounting box.

7. The fin assembly of claim 6 wherein each end cap has an end cap groove in a bottom surface thereof for receiving the reduced diameter ends of the rotating bar, and wherein the groove in the mounting blocks encompasses approximately one-half of the diameter of the reduced diameter ends of the rotating bar when disposed therein and the groove in the end caps encompasses less than one-half of the diameter of the reduced diameter ends of the rotating bar when affixed to the mounting box, and wherein the reduced ends of the rotating bar are held within the mounting block and end cap grooves in said first mode in a manner that allows the rotating bar to rotate and are squeezed between the mounting blocks and end caps in said second mode.

8. The fin assembly of claim 2 wherein the fin is releasably attachable to the rotating bar of the fin mounting unit.

9. The fin assembly of claim 8 wherein the fin comprises an extension with a cross-sectional shape that approximately matches the shape of a slot in the rotating bar of the fin mounting unit, said extension having a cantilevered finger extending along a portion of the bottom of the extension and a cutout overlying the finger and extending in front of the finger; and wherein the rotating bar has a pin that transverses the width of the slot in the bar, and wherein said fin is attachable to the rotating bar by inserting the fin's extension into the rotating bar's slot such that the bar's pin enters the part of the cutout in the fin's extension that is in front of the cantilevered finger and thereafter the fin is slid aftward such that the bar's pin rides over the finger in the part of the cutout overlying the finger until reaching the end of the cutout at the distal end of the finger, and wherein the fin is detachable from the rotating bar by sliding the fin forward so as to disengage the bar's pin from the cutout in the fin's extension.

10. A fin assembly comprising:

a fin mounting box with an elongated channel defined in part by a pair of spaced longitudinal extending sidewalls;

a rotating bar insertable within the elongated channel of the mounting box and rotatable about a longitudinally oriented axis of the mounting box;

two end caps affixable to the fin mounting box to hold the rotating bar within the fin mounting box and capable of being configured to, in a first mode, prevent the rotating bar from rotating within the mounting box, and in a second mode, allow the rotating bar to rotate within the mounting box; and a fin with a base engagable with the rotating bar; wherein the roll angle of the fin relative to the longitudinal axis of the mounting box can be adjusted by configuring the end caps in the first mode and rotating the fin and rotating bar about the longitudinal axis of the mounting box until a desired roll angle is achieved and then configuring the end caps in the second mode to fixedly hold the fin and rotating bar at the desired roll angle.

11. The fin assembly of claim 10 wherein said end caps are affixed to the mounting box with retaining screws, and wherein the end caps are configured in said first mode by loosening the retaining screws to rotate the fin and configured in said second mode by tightening said retaining screws to fixedly hold the fin.

12. The fin assembly of claim 11 wherein the fin mounting unit further comprises a pair of mounting blocks disposed at each end of the elongated channel; and wherein, said rotating bar has reduced diameter ends; and each of the mounting blocks has a mounting block groove in a top surface thereof for receiving the reduced diameter ends of the rotating bar such that the rotating bar is supported within the elongated channel by the reduced diameter ends and mounting blocks and rotatable in relation to the fin mounting box.

13. The fin assembly of claim 11 wherein:

the fin is releasably engagable with the rotating bar so as to allow the fin to be removed from the fin mounting box.

14. The fin assembly of claim 10 wherein:

wherein the fin comprises an extension with a cross-sectional shape that approximately matches the shape of a slot in the rotating bar of the fin mounting unit, said extension having a cantilevered finger extending along a portion of the bottom of the extension and a L-shaped cutout overlying the finger and extending in front of the finger; and wherein the rotating bar has a pin that transverses the width of the slot in the bar, and wherein said fin is attachable to the rotating bar by inserting the fin's extension into the rotating bar's slot such that the bars pin enters the part of the cutout in the fin's extension that is in front of the cantilevered finger and thereafter the fin is slid aftward such that the bar's pin rides over the finger in the part of the cutout overlying the finger until reaching the end of the cutout at the distal end of the finger, and wherein the fin is detachable from the rotating bar by sliding the fin forward so as to disengage the bar's pin from the cutout in the fin's extension.

* * * * *